US011808481B2

(12) United States Patent
Michaud et al.

(10) Patent No.: US 11,808,481 B2
(45) Date of Patent: Nov. 7, 2023

(54) CONDENSER FOR VENTILATION SYSTEM

(71) Applicant: Broan-NuTone LLC, Hartford, WI (US)

(72) Inventors: Stéphane Michaud, Drummondville (CA); Danic Vermette, Drummondville (CA)

(73) Assignee: Broan-NuTone LLC, Hartford, WI (US)

( * ) Notice: Subject to any disclaimer, the term of this patent is extended or adjusted under 35 U.S.C. 154(b) by 91 days.

(21) Appl. No.: 17/481,445

(22) Filed: Sep. 22, 2021

(65) Prior Publication Data

US 2022/0128266 A1 Apr. 28, 2022

Related U.S. Application Data

(60) Provisional application No. 63/105,991, filed on Oct. 27, 2020.

(51) Int. Cl.
*F24F 12/00* (2006.01)
*F24F 13/22* (2006.01)

(52) U.S. Cl.
CPC ..... *F24F 13/222* (2013.01); *F24F 12/006* (2013.01); *F24F 2013/227* (2013.01)

(58) Field of Classification Search
CPC ..... F24F 13/222; F24F 12/006
See application file for complete search history.

(56) References Cited

U.S. PATENT DOCUMENTS

| | | | | |
|---|---|---|---|---|
| 5,193,610 | A * | 3/1993 | Morissette | F24F 12/006 165/909 |
| 5,913,360 | A * | 6/1999 | Stark | F28D 9/0062 62/93 |
| 6,347,527 | B1 * | 2/2002 | Bailey | F24F 3/001 165/59 |
| 7,334,632 | B2 * | 2/2008 | Bassilakis | F28F 27/02 165/4 |
| 8,162,042 | B2 * | 4/2012 | Haglid | F28F 21/065 165/165 |
| 9,605,905 | B2 * | 3/2017 | Haglid | F24F 12/006 |
| 9,644,852 | B2 * | 5/2017 | Guercio | F24F 1/04 |
| 9,901,760 | B2 * | 2/2018 | Erb | A62C 2/065 |

* cited by examiner

*Primary Examiner* — Christopher R Zerphey
(74) *Attorney, Agent, or Firm* — Barnes & Thornburg LLP

(57) ABSTRACT

A ventilation system in accordance with the present disclosure includes a housing and a core unit arranged in the housing. A fresh air inlet, an exhaust air inlet, a fresh air outlet, and an exhaust air outlet are arranged on the housing. The core unit is arranged between the inlets and outlets to transfer heat and/or humidity between fresh air and exhaust air flowing through the ventilation system. The exhaust air flows through ducting to an exhaust port in a wall of a building structure.

26 Claims, 9 Drawing Sheets

BASEMENT INSTALLATION
DIAGRAM-FULLY DUCTED

BASEMENT INSTALLATION
DIAGRAM-EXTENDED EXHAUST

CONDENSER FOR VENTILATION SYSTEM

BACKGROUND

Ventilation systems 100 are used to regulate and maintain the air quality within a structure, such as a building structure 300 or 400. As shown in FIGS. 13 and 14, this is accomplished by replacing stale indoor air (exhausted through a port 109) with fresh outdoor air (received through a port 302). Two types of devices used in ventilation systems 100 that to recover energy from the stale indoor air are heat recovery ventilator (HRV) cores and energy recovery ventilator (ERV) cores (both collectively identified as 103 in the figures). As shown in FIGS. 15-17, HRV and ERV cores reduce wasted energy by transferring energy from the stale indoor air (i.e. "exhaust air") to the fresh outdoor air (i.e. "supply air"). In certain climates, the use of an ERV core may be desirable over an HRV core. This is because an ERV core allows moisture as well as heat to be exchanged between the exhaust air and the supply air. For example, FIG. 16 shows a hot and humid climate, where an ERV core 103 can lower humidity levels within the building by allowing some of the moisture that is contained within the supply air to be transferred to the relatively drier exhaust air. This helps to reduce the likelihood of growing mold, bacteria, viruses, and fungi within the structure. Also, FIG. 17 shows a cold dry climate, where an ERV core can help maintain the humidity levels within the building by allowing some of the moisture that is contained within the exhaust air to be transferred to the supply air. This helps to reduce skin irritation, dryness, and respiratory symptoms caused by dry air.

In colder climates, ducting 105 connecting the ventilation system 100 with the exhaust port 109 can become filled with cold air during periods of inactivity of the ventilation system 100. Exhaust air leaving the ventilation system 100 can be relatively humid and water condensate can accumulate in the ducting 105 from interaction with the cold air and/or ducting. This water condensate can accumulate and create leaks or freeze and possibly block air flow through the ducting 105. Accordingly, this disclosure describes various embodiments of devices for the control of water condensate in ventilation systems.

SUMMARY

A ventilation system in accordance with the present disclosure includes a housing and a core unit arranged in the housing. A fresh air inlet, an exhaust air inlet, a fresh air outlet, and an exhaust air outlet are arranged on the housing. The core unit is arranged between the inlets and outlets to transfer heat and/or humidity between fresh air and exhaust air flowing through the ventilation system. The exhaust air flows through ducting to an exhaust port in a wall of a building structure.

In illustrative embodiments, a condenser in accordance with the present disclosure is coupled to the exhaust air outlet. The condenser includes a grid and a mount ring coupled to the grid. The grid includes a plurality of spaced apart plates defining slots for the exhaust air to pass through the condenser into the ducting. The grid engages with the exhaust air passing through the condenser to induce water condensate from humidity in the exhaust air. The water condensate induced by the condenser is directed away from the ducting.

This background information is merely for context and no admission is intended, nor should such admission be inferred or construed, that any of the preceding information constitutes prior art against the present disclosure. Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
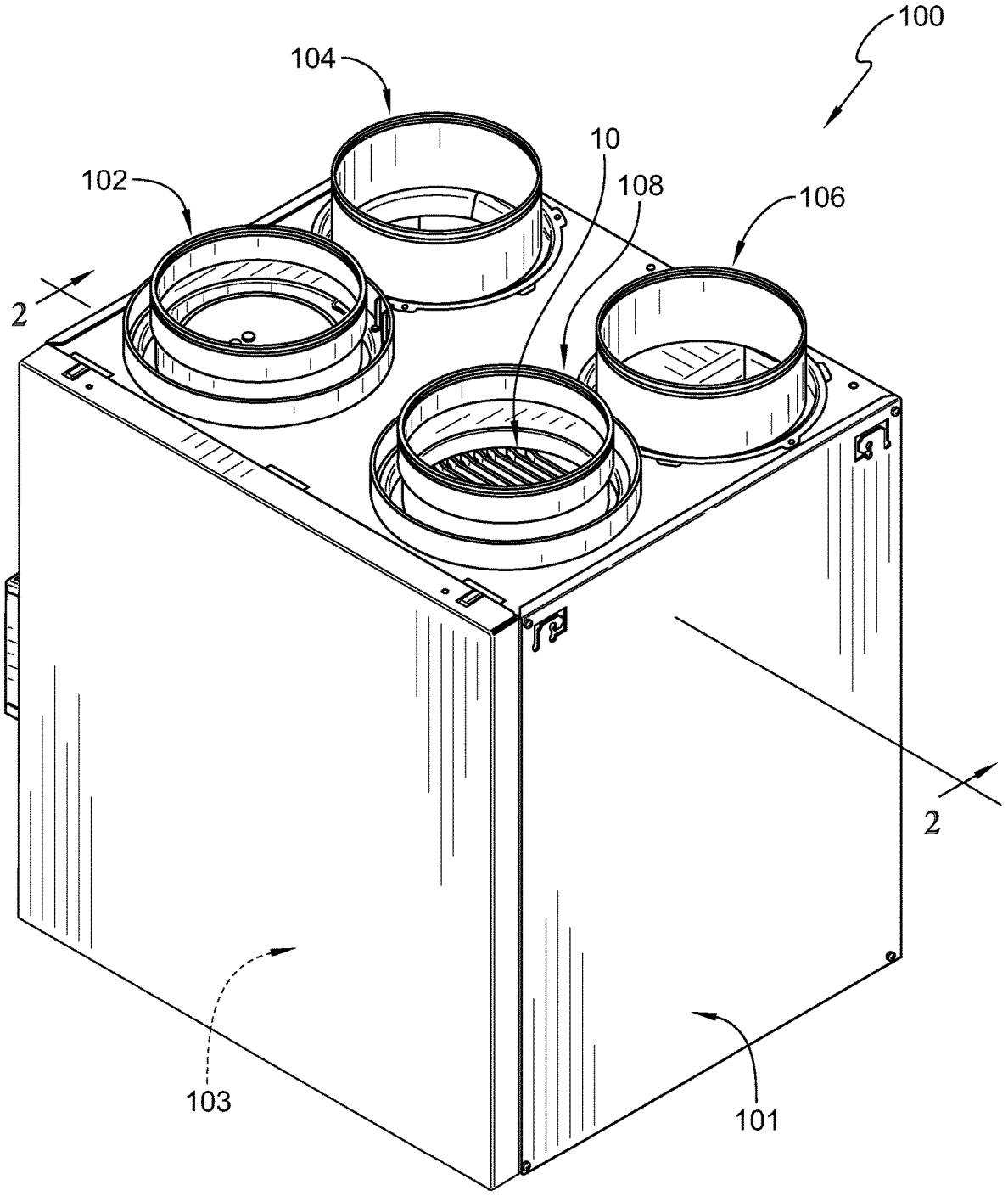
FIG. 1 is an upper perspective view of an embodiment of ventilation system in accordance with the present disclosure.
Figure 15:
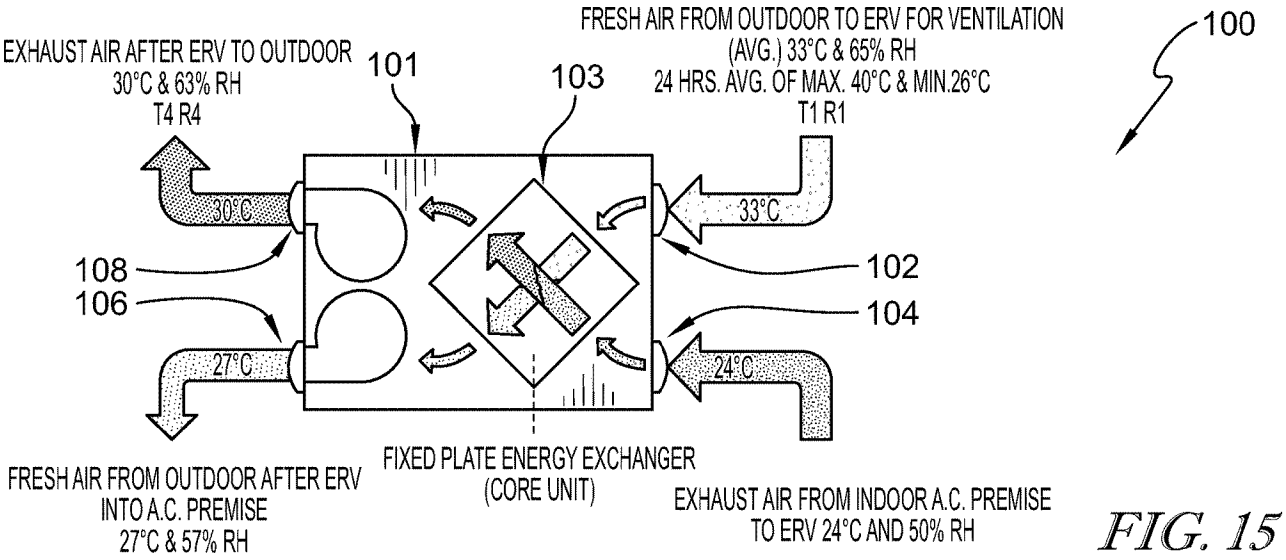
FIG. 15 is a diagrammatic view of a ventilation system.
Figure 17:
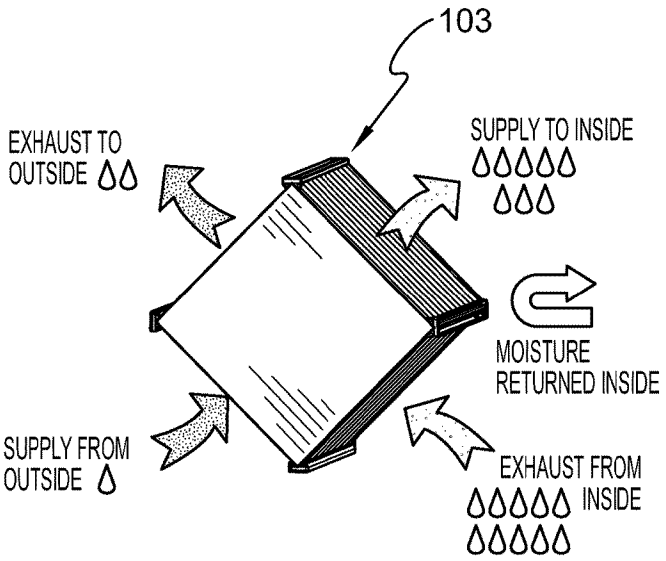
FIG. 17 is a diagrammatic view of a core unit of a ventilation system.
Figure 16:
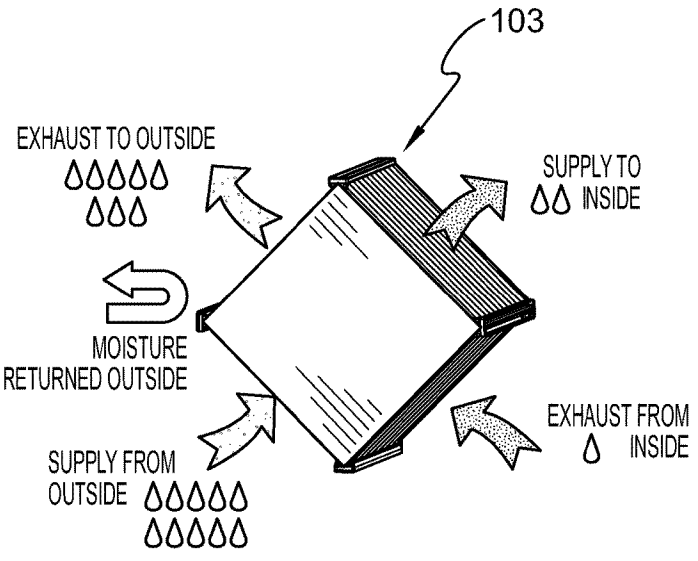
FIG. 16 is a diagrammatic view of a core unit of a ventilation system.

An embodiment of a ventilation system 100 in accordance with the present disclosure is shown in FIG. 1. The ventilation system 100 includes a housing 101 and a core unit 103 arranged in the housing 101. A fresh air inlet 102, an exhaust air inlet 104, a fresh air outlet 106, and an exhaust air outlet 108 are arranged on the housing 101 to pass flows of exhaust air and fresh air through the ventilation system 100. The core unit 103 is arranged between the inlets 102, 104 and outlets 106, 108 to transfer heat and/or humidity between the fresh air and exhaust air flowing through the ventilation system 100 as shown in FIGS. 15-17.

Figure 2:
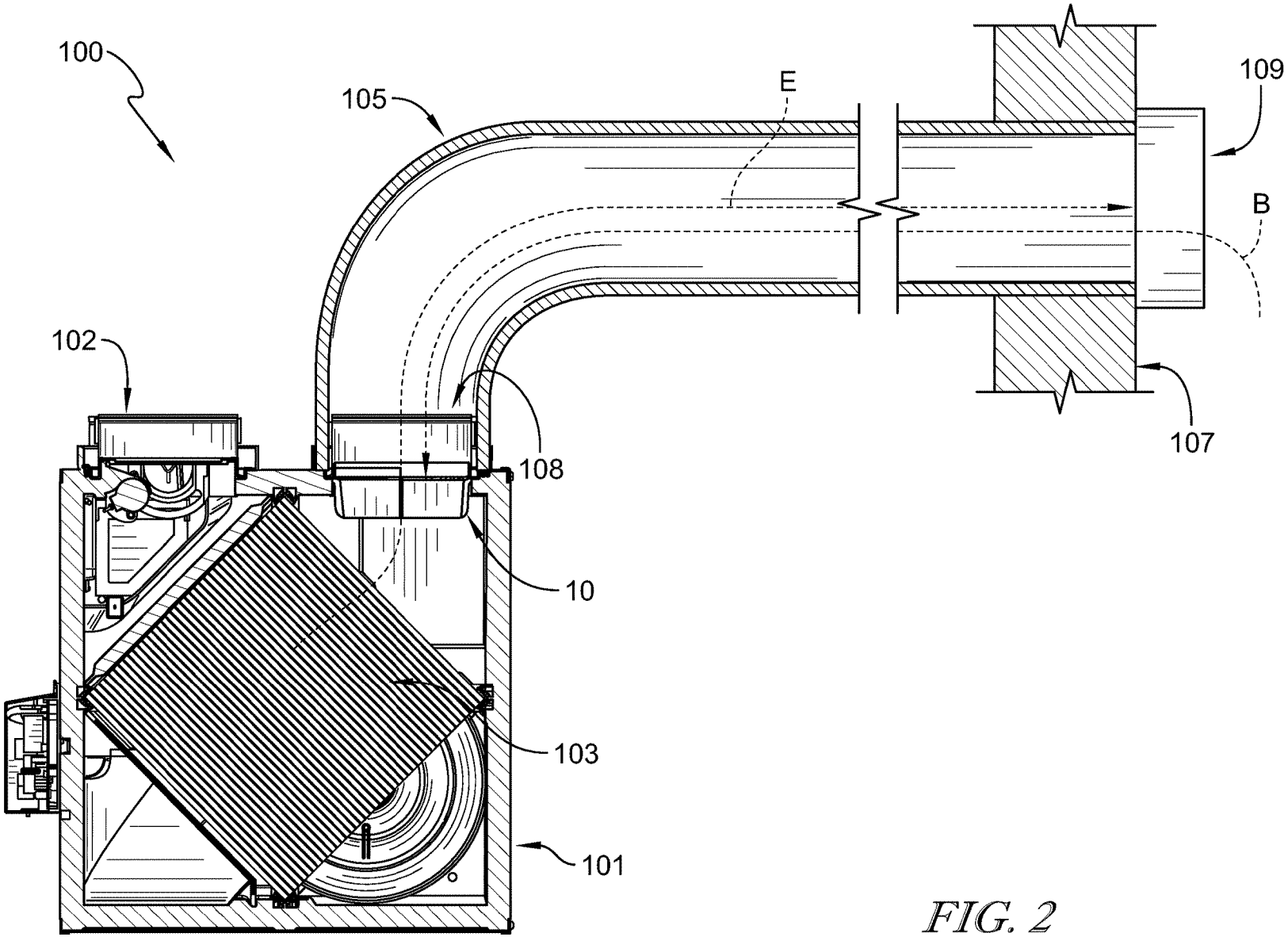
FIG. 2 is a sectional view taken along line 2-2 in FIG. 1.
Figure 13:
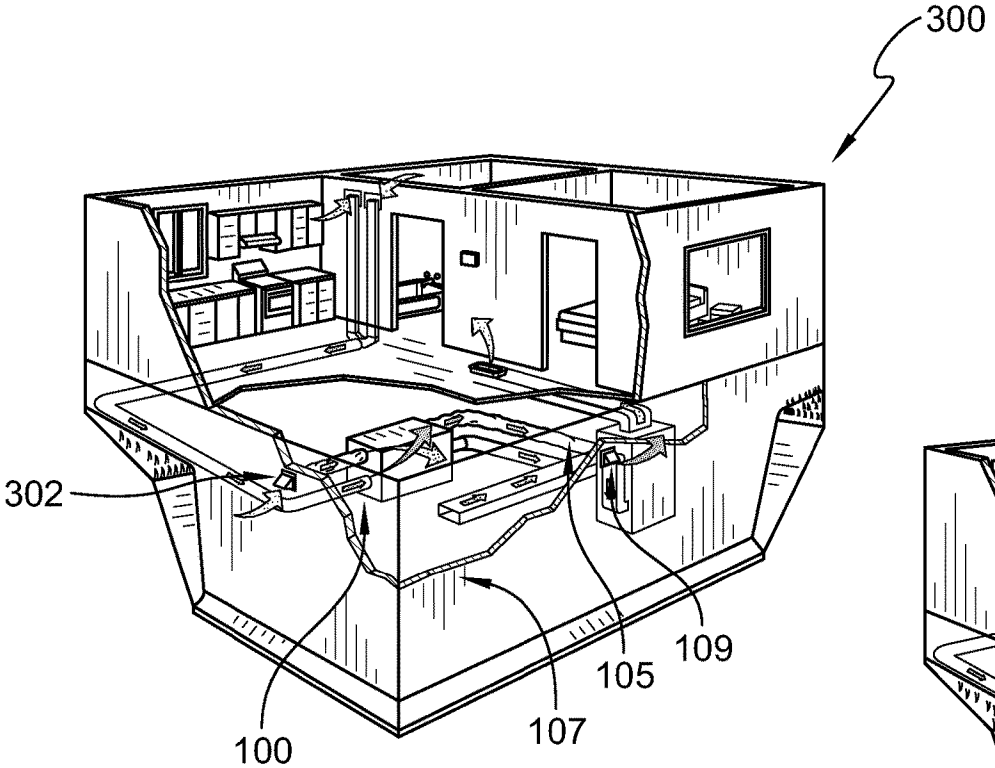
FIG. 13 is a perspective view of a building structure having a ventilation system.

In the illustrative embodiment, a condenser 10 in accordance with the present disclosure is coupled to the exhaust air outlet 108 as shown in FIGS. 1 and 2. The exhaust air (E) exiting the ventilation system 100 through the exhaust air outlet 108 flows through ducting 105 to an exhaust port 109 in a wall 107 of a building structure, such as building structure 300 shown in FIG. 13. In colder climates, ducting 105 connecting the ventilation system 100 with the exhaust port 109 can become filled with a back flow (B) of cold air during periods of inactivity of the ventilation system 100 that can cool the condenser 10. Warm, humid exhaust air (E)

flows through the condenser 10 when the ventilation system 100 is active and the condenser 10 engages with the exhaust air (E) to induce water condensate from the humidity in the exhaust air (E). The water condensate induced by the condenser 10 is directed away from the ducting 105, such as back into the ventilation system 100, for drainage.

Figure 3:
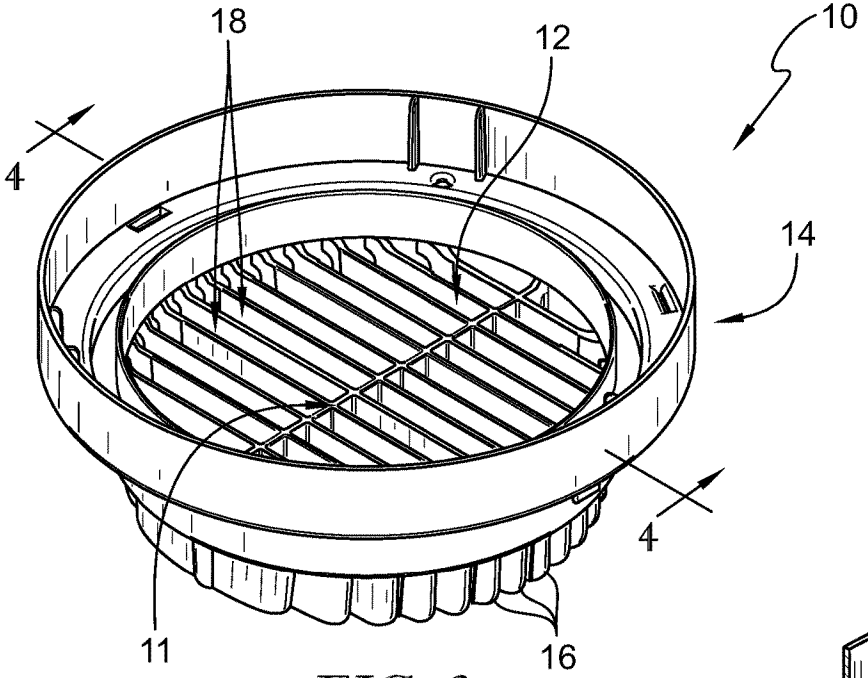
FIG. 3 is an upper perspective view of an embodiment of a condenser in accordance with the present disclosure.
Figure 4:
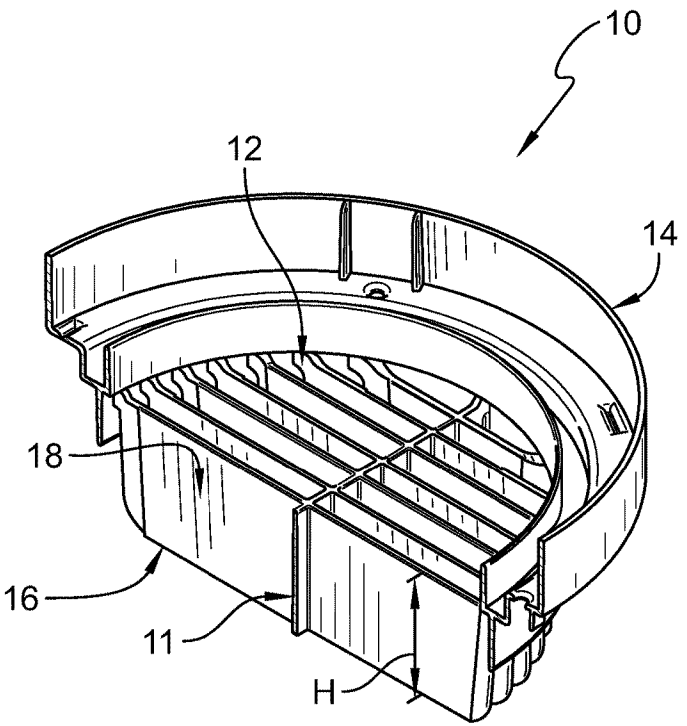
FIG. 4 is a perspective sectional view taken along line 4-4 in FIG. 3.

An embodiment of a condenser 10 in accordance with the present disclosure is shown in FIGS. 3 and 4. The exemplary condenser 10 includes a grid 12 and a mount ring 14 coupled to the grid 12. The grid 12 includes a plurality of spaced apart plates 16 defining slots 18 therebetween for the exhaust air to pass through the condenser 10 into the ducting 105. The plates 16 provide elongated surfaces for water condensate to form as the exhaust air (E) contacts the grid 12, and the slots 18 allow the exhaust air (E) to flow though the grid 12. In the illustrative embodiment, the plates 16 are substantially parallel to one another and the grid 12 extends across the exhaust air outlet 108. In some embodiments, one or more ribs 11 extend across the grid 12 substantially perpendicular to the plates 16. In some embodiments, the plates 16 are substantially flat. In some embodiments, the plates 16 assume other shapes, such as corrugated. In some embodiments, the grid 12 is formed as a unitary and integral component. The mount ring 14 couples to the housing 101 to position the grid 12 relative to the exhaust air outlet 108 as shown in FIG. 2. The plates 16 of the grid 12 extend away from the mount ring 14 (e.g., away from the ducting 105 and downward in the orientation of FIGS. 2-4), past a lowermost edge of the mount ring 14, and into the housing 101. In some embodiments, the grid 12 and mount ring 14 are formed together as a unitary and integral component. In some embodiments, the grid 12 is formed of a heat conductive material, such as metal. In other embodiments, the grid 12 can be plastic or any other suitable material.

Figure 6:
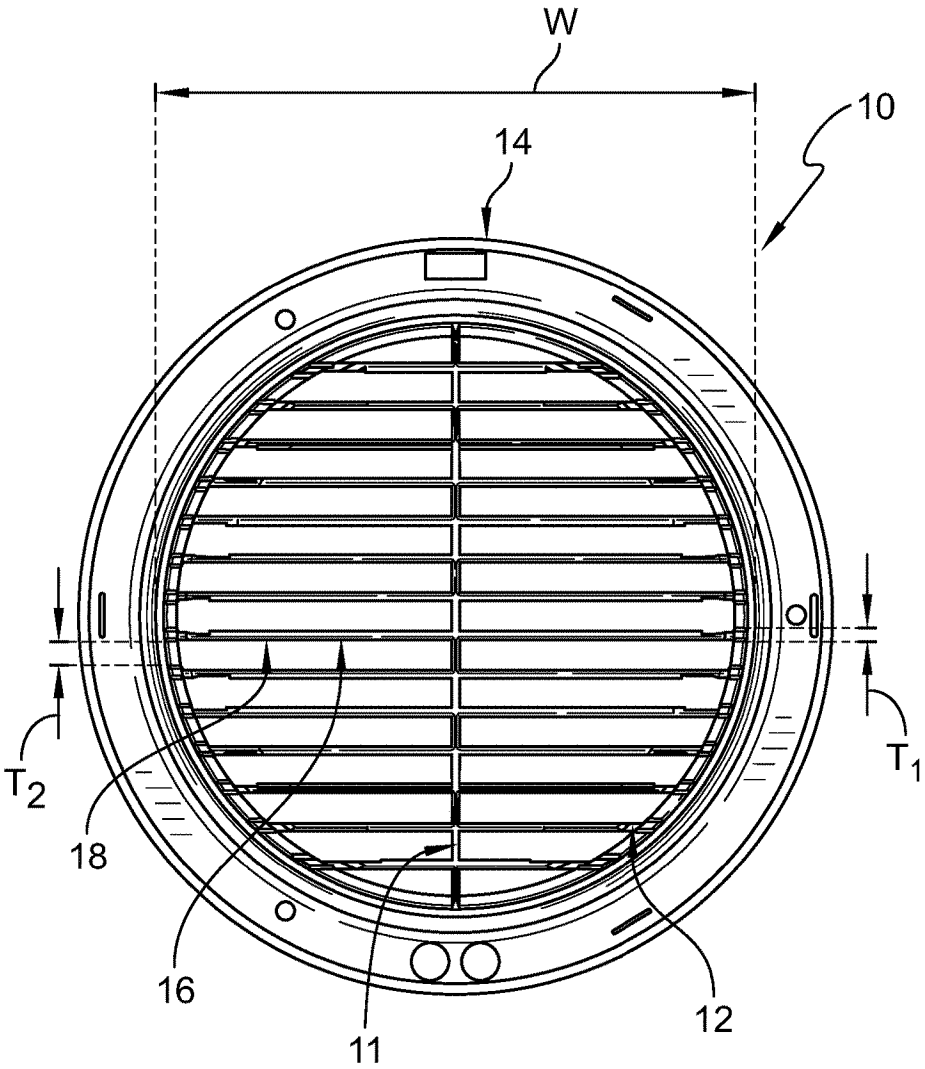
FIG. 6 is a bottom plan view of the condenser of FIG. 5.
Figure 5:
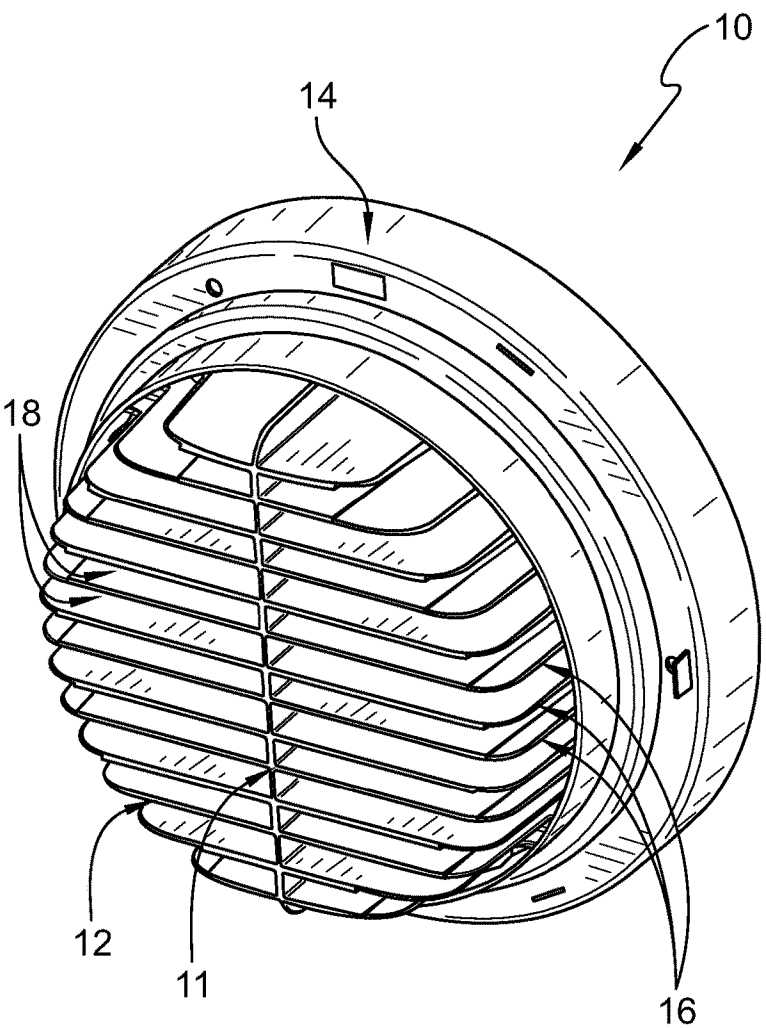
FIG. 5 is a lower perspective view of the condenser of FIG. 3.

The plates 16 have a height (H), width (W), and thickness ($T_1$), and the slots 18 have a thickness ($T_2$) as shown in FIGS. 4 and 6. In the illustrative embodiment, each of the plates 16 has substantially the same height (H) and thickness ($T_1$), the widths (W) of the plates 16 vary across the grid 12, and the plates 16 are spaced apart such that each slot 18 has substantially the same thickness ($T_2$). In some embodiments, the height (H), width (W), and thickness ($T_1$) of the plates 16 and thickness ($T_2$) of the slots 18 can be consistent or variable across the grid 12. In some embodiments, an inner diameter of the mount ring 14 is about 5.61 inches, the height (H) of the plates 16 is about 1.59 inches, the width (W) of the center-most plates 16 are about 5.83 inches, the width (W) of the outer-most plates 16 are about 3.25 inches, the thickness ($T_1$) of the plates 16 is about 0.079 inches, the thickness ($T_2$) of the slots 18 is about 0.27 inches, and a thickness of the rib 11 is about 0.078 inches. Other sizes and arrangements are contemplated by the present disclosure, and the above exemplary embodiments should not be considered limiting. For example, in some embodiments, annular walls of varying diameter are arranged concentric to one another to provide gaps therebetween, with the annular walls having similar height and thickness to the plates 16 and the gaps having similar thickness to the slots 18.

Figure 7:
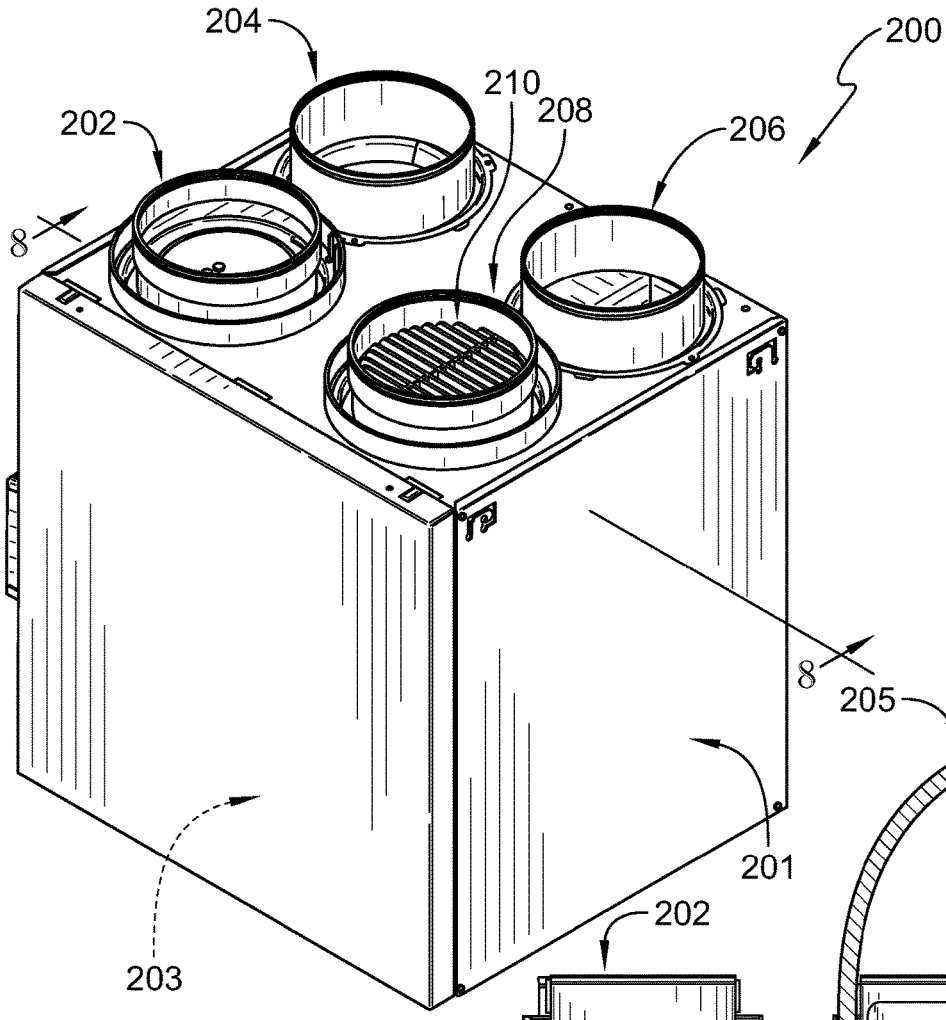
FIG. 7 is an upper perspective view of another embodiment of ventilation system in accordance with the present disclosure.
Figure 8:
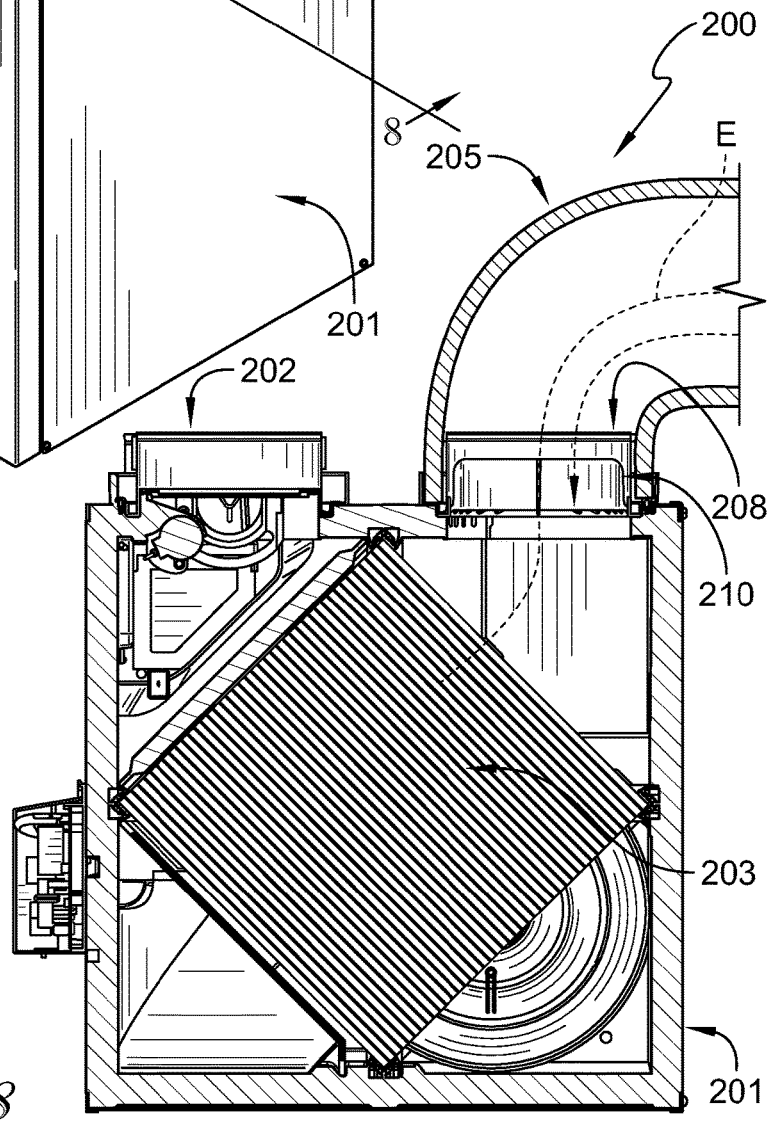
FIG. 8 is a sectional view taken along line 8-8 in FIG. 7.

Another embodiment of a ventilation system 200 in accordance with the present disclosure is shown in FIGS. 7 and 8. The ventilation system 200 is similar to the ventilation system 100 with similar numbers in the 200's used to identify similar components. At least one difference between the ventilation system 100 and the ventilation system 200 is that a condenser 210 is coupled to the exhaust outlet 208 instead of the condenser 10 of FIGS. 1-6. An embodiment of a condenser 210 in accordance with the present disclosure is shown in FIGS. 9-12. The condenser 210 is similar to the condenser 10 with similar numbers in the 200's used to identify similar components. At least one difference between the condenser 10 and the condenser 210 is that the grid 212 extends away from the housing 201 and toward the ducting 205. In the illustrative embodiment, the plates 216 of the grid 212 extend into the mount ring 214 (e.g., upward in the orientation of FIGS. 8-10). In some embodiments, the grid 212 is formed as a unitary and integral component. In some embodiments, the grid 212 and mount ring 214 are formed together as a unitary and integral component. In some embodiments, the grid 212 is formed of a heat conductive material, such as metal. In other embodiments, the grid 212 can be plastic or any other suitable material.

Figure 10:
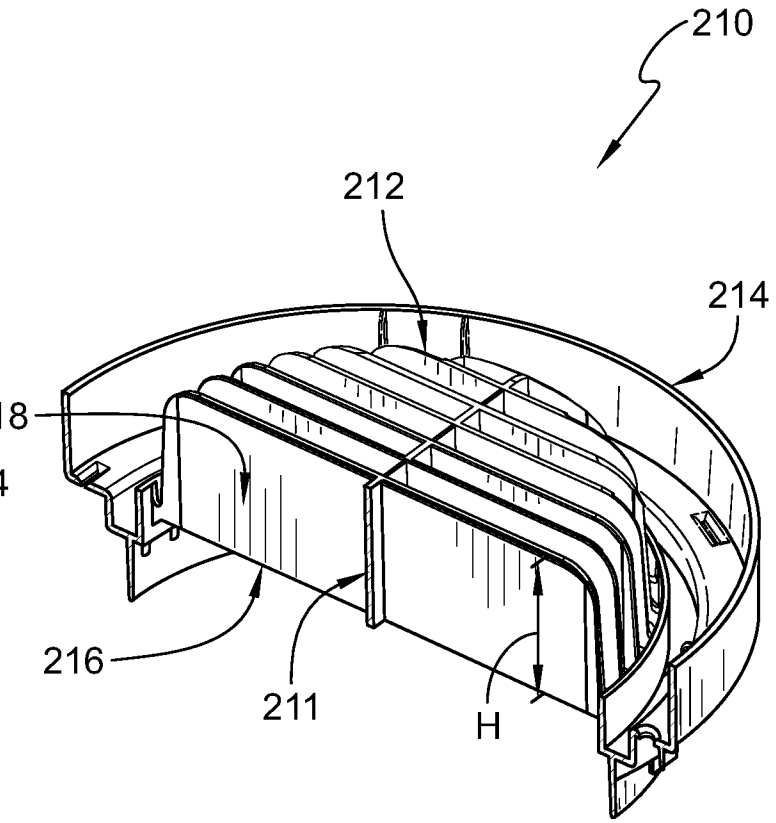
FIG. 10 is a perspective sectional view taken along line 10-10 in FIG. 9.
Figure 9:
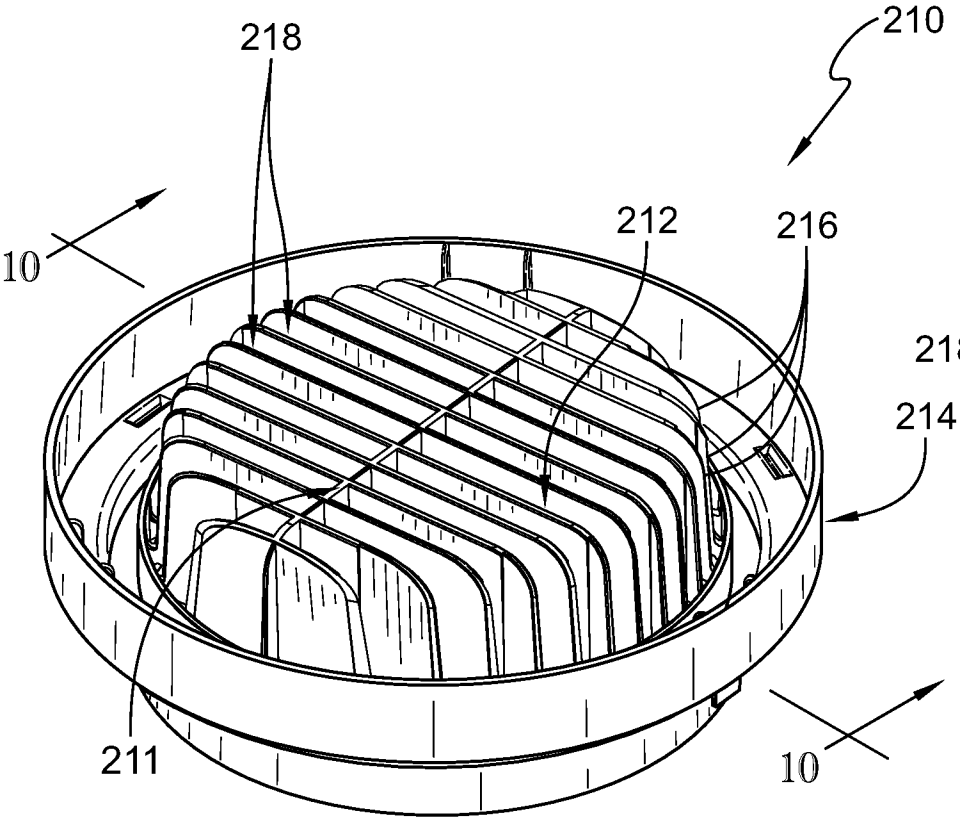
FIG. 9 is an upper perspective view of another embodiment of a condenser in accordance with the present disclosure.
Figure 12:
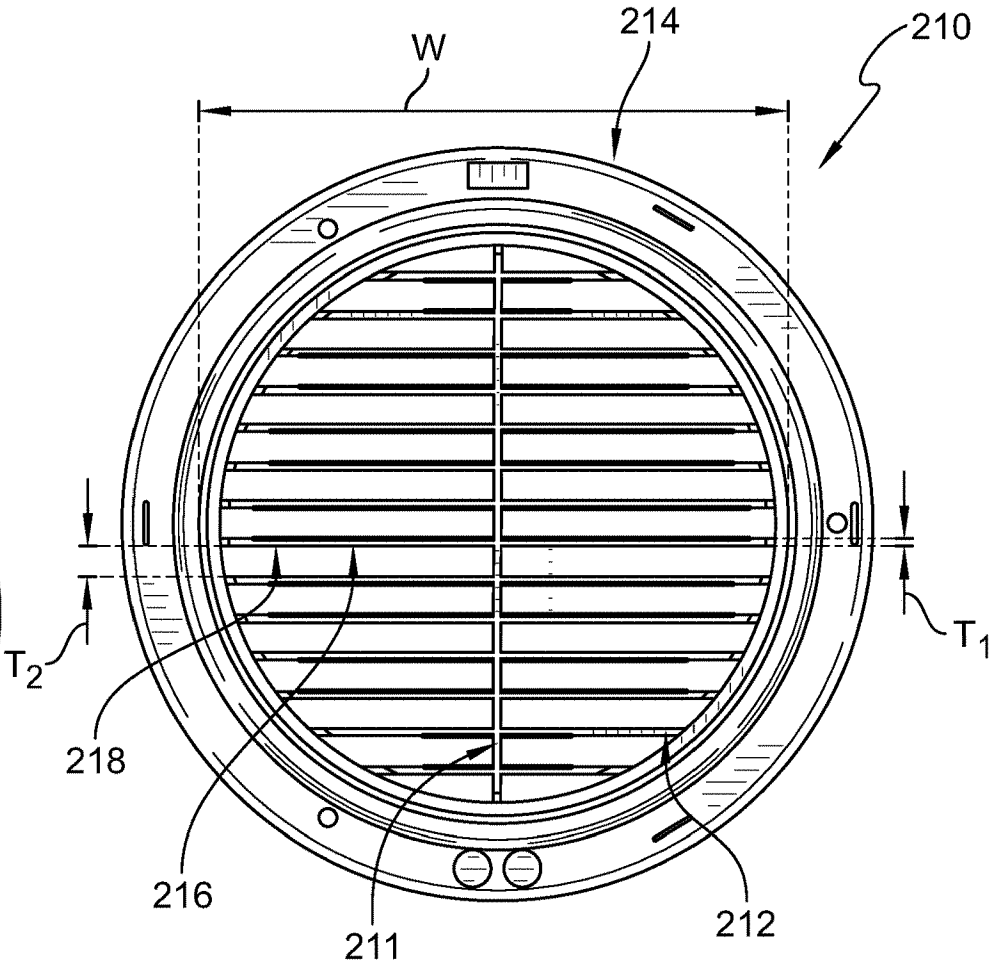
FIG. 12 is a bottom plan view of the condenser of FIG. 11.
Figure 11:
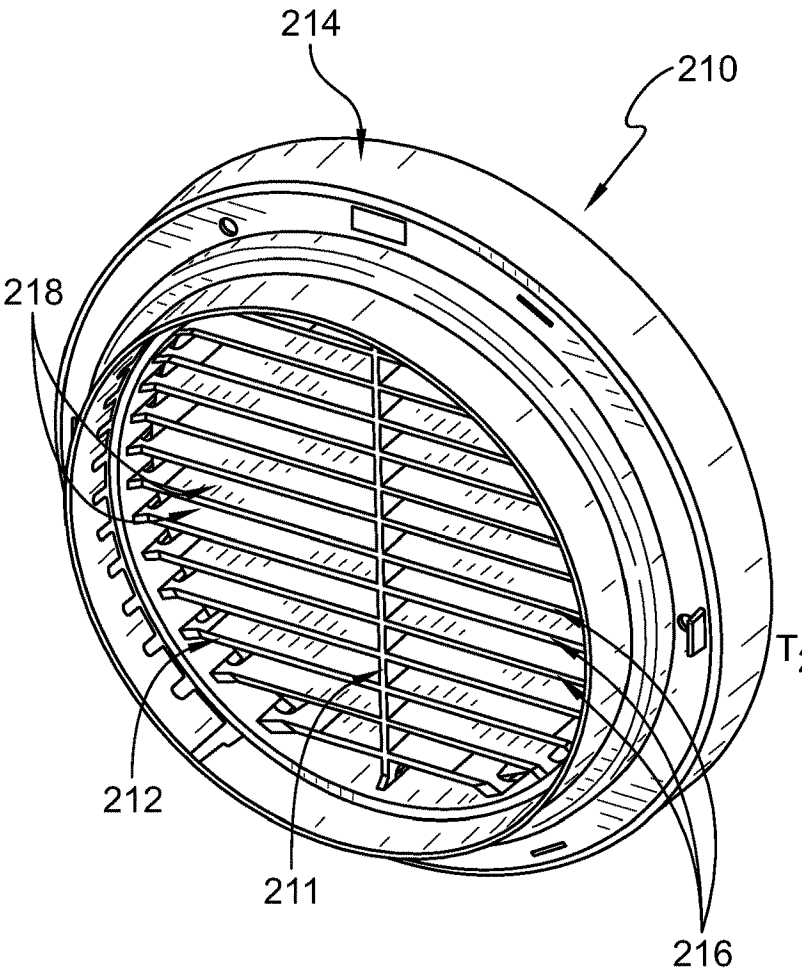
FIG. 11 is a lower perspective view of the condenser of FIG. 9.
Figure 14:
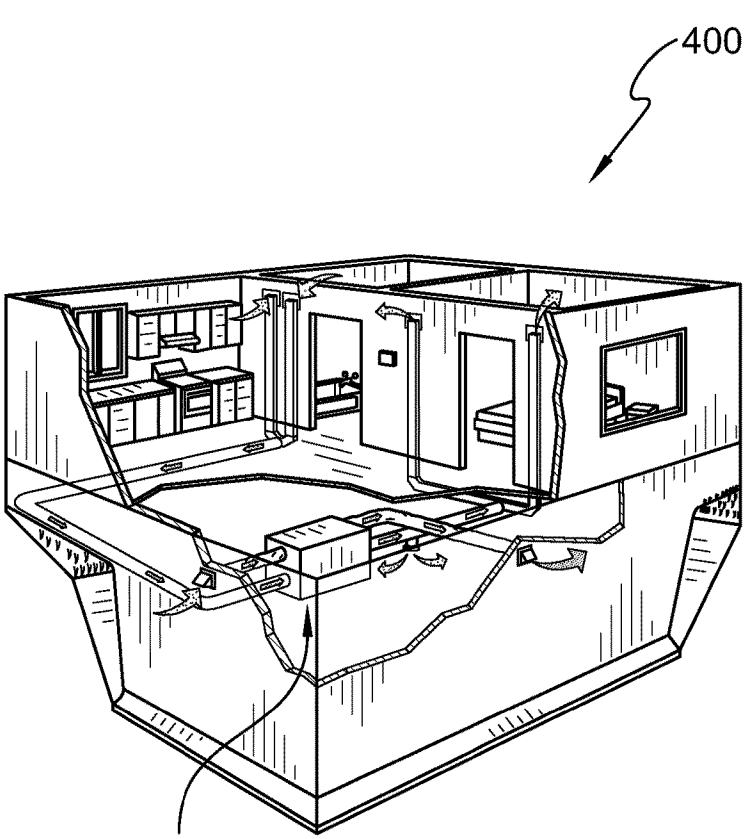
FIG. 14 is a perspective view of a building structure having a ventilation system.

The plates 216 have a height (H), width (W), and thickness ($T_1$), and the slots 218 have a thickness ($T_2$) as shown in FIGS. 10 and 12. In the illustrative embodiment, each of the plates 216 has substantially the same height (H) and thickness ($T_1$), the widths (W) of the plates 216 vary across the grid 212, and the plates 216 are spaced apart such that each slot 218 has substantially the same thickness ($T_2$). In some embodiments, the height (H), width (W), and thickness ($T_1$) of the plates 216 and thickness ($T_2$) of the slots 218 can be consistent or variable across the grid 212. In some embodiments, an inner diameter of the mount ring 214 is about 5.59 inches, the height (H) of the plates 216 is about 1.6 inches, the width (W) of the center-most plates 216 are about 5.59 inches, the width (W) of the outer-most plates 216 are about 2.63 inches, the thickness ($T_1$) of the plates 216 is about 0.076 inches, the thickness ($T_2$) of the slots 218 is about 0.3 inches, and a thickness of the rib 211 is about 0.076 inches. In some embodiments, the plates 216 are substantially flat. In some embodiments, the plates 216 assume other shapes, such as corrugated. Other sizes and arrangements are contemplated by the present disclosure, and the above exemplary embodiments should not be considered limiting. For example, in some embodiments, annular walls of varying diameter are arranged concentric to one another to provide gaps therebetween, with the annular walls having similar height and thickness to the plates 216 and the gaps having similar thickness to the slots 218.

In illustrative embodiments, a condenser in accordance with the present disclosure includes a grid and a mount ring coupled to the grid. The grid extends partially into the housing away from the ducting and partially toward the ducting away from the housing.

In illustrative embodiments, a condenser includes spaced condensing plates in exhausted air flow between heat/energy recovery core and exhaust ducting to the outside environment. The condenser allows transfer of heat from the warmer section of unmixed air flow to the colder section of the air flow, with the condensing plates acting as fins to transfer heat. The surfaces of the condensing plates are cooled down below the dew point of the warm section of the unmixed air flow. Water vapor present in the air, as humidity, then condenses on the cold plates before it enters the ducting. The condensing plates also force water from condensation to return into the ventilation system or in a drain. The condensing plates protect exhaust ducting from water accumulation, water leakage, and/or ice build up. The condensing plates could be made of metal, plastic, or other heat conductive material. The condensing plates could be located inside or outside of the housing and return water from condensation into the housing or in a drain. The condenser could be made of spaced fins or a thermal mass in contact with both cold and warm region of the exhaust air flow between the heat/energy core and the exhaust port to the outside environment. The condenser could be made in a single piece, in several pieces, or merged with another part of the ventilation system.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the term "include," "have," or the like is used in the description or the claims, such term is intended to be inclusive in a manner similar to the term "comprise" as "comprise" is interpreted when employed as a transitional word in a claim. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

Further, the claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The invention claimed is:

1. A ventilation system comprising:

a housing comprising a plurality of outer walls defining an interior;

a core unit arranged in the interior of the housing;

a fresh air inlet, an exhaust air inlet, a fresh air outlet, and an exhaust air outlet defined in the housing to pass flows of exhaust air and fresh air through the ventilation system; and a condenser located in the exhaust air outlet extending both into the housing interior and beyond the housing outer walls to an exterior of the housing;

wherein the core unit is arranged between the inlets and the outlets to transfer at least one of heat and humidity between the fresh air and exhaust air flowing through the ventilation system, and wherein the condenser is configured to engage with the exhaust air flowing out of the exhaust air outlet to induce water condensate from humidity in the exhaust air.

2. The ventilation system of claim 1, wherein the condenser includes a grid and a mount ring coupled to the grid, and wherein the mount ring couples to the housing to position the grid relative to the exhaust air outlet.

3. The ventilation system of claim 2, wherein the grid includes a plurality of spaced apart plates defining slots therebetween for the exhaust air to pass through the condenser, and wherein the plates are configured to provide elongated surfaces for water condensate to form as the exhaust air contacts the grid.

4. The ventilation system of claim 3, wherein the plates are substantially parallel to one another.

5. The ventilation system of claim 4, further comprising a rib extending across the grid substantially perpendicular to the plates.

6. The ventilation system of claim 3, wherein the grid is formed as a unitary and integral component.

7. The ventilation system of claim 2, wherein the grid and the mount ring are formed as a unitary and integral component.

8. The ventilation system of claim 2, further comprising ducting coupled to the exhaust air outlet, wherein the water condensate induced by the condenser is directed away from the ducting for drainage.

9. The ventilation system of claim 8, wherein the grid extends toward the ducting and away from the housing.

10. The ventilation system of claim 8, wherein the grid extends away from the ducting and into the housing.

11. A condenser for use with an exhaust air outlet of a ventilation system having a housing comprised of a plurality of outer walls defining an interior, the condenser comprising:

a grid having a plurality of spaced apart plates defining slots therebetween for exhaust air to pass through the condenser, the grid configured to be located in an exhaust air outlet define in one of the plurality of outer walls; and a mount ring coupled to the grid, the mount ring arranged to couple to a housing of the ventilation system to position the grid relative to the exhaust air outlet, wherein the plates are configured to provide elongated surfaces for water condensate to form as the exhaust air contacts the grid, and wherein the condenser is configured to extend both into the housing interior and beyond the housing outer walls to an exterior of the housing.

12. The condenser of claim 11, wherein the grid is formed as a unitary and integral component.

13. The condenser of claim 11, wherein the grid and the mount ring are formed as a unitary and integral component.

14. The condenser of claim 11, wherein the plates are substantially parallel to one another.

15. The condenser of claim 14, further comprising a rib extending across the grid substantially perpendicular to the plates.

16. The condenser of claim 15, wherein each plate has a width, a height, and a first thickness, wherein the plates are spaced apart to define the slots, and wherein each slot has a second thickness.

17. The condenser of claim 16, wherein the widths of the plates vary across the grid.

18. The condenser of claim 17, wherein the first thicknesses are substantially the same, and wherein the second thicknesses are substantially the same.

19. The condenser of claim 11, wherein the grid extends away from the mount ring.

20. The condenser of claim 11, wherein the grid extends into the mount ring.

21. The ventilation system of claim 1, wherein the mount ring extends beyond the housing walls into the exterior of the housing.

22. The ventilation system of claim 2, wherein the grid extends from the interior of the housing beyond the housing walls into the exterior of the housing.

23. The ventilation system of claim 3, wherein one or more of the plurality of spaced apart plates extends from the interior of the housing beyond the housing walls into the exterior of the housing.

24. The condenser of claim 11, wherein the condenser is configured to extend from the interior of the housing beyond the housing walls into the exterior of the housing.

25. The condenser of claim 11, wherein the grid extends from the interior of the housing beyond the housing walls into the exterior of the housing.

26. The condenser of claim 11, wherein one or more of the plurality of spaced apart plates extends from the interior of the housing beyond the housing walls into the exterior of the housing.

* * * * *